US009582943B1

(12) United States Patent
Morrison et al.

(10) Patent No.: US 9,582,943 B1
(45) Date of Patent: Feb. 28, 2017

(54) DRIVING DATA COLLECTION

(71) Applicant: True Mileage, Inc., Oakland, CA (US)

(72) Inventors: Ryan N. Morrison, Oakland, CA (US); Gregory P. Defouw, Redwood City, CA (US)

(73) Assignee: True Mileage, Inc., Oakland, CA (US)

( * ) Notice: Subject to any disclaimer, the term of this patent is extended or adjusted under 35 U.S.C. 154(b) by 70 days.

(21) Appl. No.: 14/172,797

(22) Filed: Feb. 4, 2014

Related U.S. Application Data

(60) Provisional application No. 61/761,193, filed on Feb. 5, 2013, provisional application No. 61/761,191, filed on Feb. 5, 2013.

(51) Int. Cl.
*G07C 5/00* (2006.01)
*G07C 5/08* (2006.01)

(52) U.S. Cl.
CPC ..... *G07C 5/008* (2013.01); *G07C 5/0858* (2013.01)

(58) Field of Classification Search
CPC ..... G07C 5/008; G07C 5/0858
See application file for complete search history.

(56) References Cited

U.S. PATENT DOCUMENTS 5,684,828 A * 11/1997 Bolan ..... G06K 7/0021 340/10.2
5,797,134 A * 8/1998 McMillan ..... G07C 5/008 705/4
6,263,322 B1 * 7/2001 Kirkevold ..... G06Q 30/0283 705/400
6,611,755 B1 * 8/2003 Coffee ..... G07C 5/008 701/482
6,868,386 B1 * 3/2005 Henderson ..... G07C 5/008 340/439
7,117,075 B1 * 10/2006 Larschan ..... G07C 5/008 701/33.4
8,090,598 B2 * 1/2012 Bauer ..... G07C 5/008 701/117
8,140,358 B1 * 3/2012 Ling ..... G07C 5/008 340/439
2003/0088347 A1 * 5/2003 Ames ..... G07C 5/008 701/31.4
2004/0123114 A1 * 6/2004 McGowan ..... G07C 9/00087 713/186

(Continued)

OTHER PUBLICATIONS

Evogi, Bob Mathe, Telematics Discussion—Day in the life of a hard braking incident, Electronics of Usage Based Insurance, The Evogi Group Inc., created Oct. 1, 2011, presented Oct. 4, 2011, 17 pages (33 powerpoint slide images).*

*Primary Examiner* — Dale W Hilgendorf
(74) *Attorney, Agent, or Firm* — Fenwick & West LLP

(57) ABSTRACT

Driving data are collected from a vehicle by a device. The device comprises a vehicle interface for interfacing with an on-board diagnostics system of a vehicle and retrieving vehicle parameters of the vehicle from the on-board diagnostics system. The retrieved vehicle parameters include a vehicle identification parameter and driving parameters. The device includes a processor configured to identify the vehicle based on the vehicle identification parameter and determine data describing how the vehicle is driven based on the retrieved vehicle parameters. The device also includes an output interface configured to output the determined data.

10 Claims, 4 Drawing Sheets

(56) References Cited

U.S. PATENT DOCUMENTS

| | | | | |
|---|---|---|---|---|
| 2004/0153362 | A1* | 8/2004 | Bauer | G07C 5/008 705/4 |
| 2005/0182535 | A1* | 8/2005 | Huang | H04L 43/50 701/31.4 |
| 2006/0017552 | A1* | 1/2006 | Andreasen | G07C 5/0825 701/1 |
| 2006/0095233 | A1* | 5/2006 | Carr | G06F 11/0739 702/185 |
| 2007/0032949 | A1* | 2/2007 | Arai | G01C 21/00 701/420 |
| 2008/0132270 | A1* | 6/2008 | Basir | G07C 5/008 455/550.1 |
| 2008/0285565 | A1* | 11/2008 | Gunther | H04L 45/00 370/394 |
| 2011/0050164 | A1* | 3/2011 | Partovi | H01F 5/003 320/108 |
| 2011/0106374 | A1* | 5/2011 | Margol | G07C 5/008 701/31.4 |
| 2012/0072334 | A1* | 3/2012 | Feinstein | G06Q 40/02 705/38 |

* cited by examiner

400

405

410

| Properties | |
|---|---|
| Postcard ID | 2 |
| Device ID | 2440569c |
| VIN | 1J4GA69139L7099931 |
| OBD Protocol | CAN |
| First Connect (days) | 124 |
| Disconnects | 1 |
| Long Disconnects (>5min) | 0 |
| Disconnects (days) | 0 |
| Long Disconnects (days) | 0 |
| Annual Miles | 231 |
| Annual Minutes | 7492 |
| Annual Trips | 83 |
| Annual Acceleration (# above threshold) | 4 |

DRIVING DATA COLLECTION

CROSS-REFERENCE TO RELATED APPLICATIONS

This application claims the benefit of U.S. Provisional Application No. 61/761,193, filed Feb. 5, 2013, which is incorporated herein by reference in its entirety.

BACKGROUND

Driving data can be used for a number of applications, such as mileage- and driving-based fees or rebates, vehicle maintenance and repair, vehicle resale, driver information, accident reconstruction, legal issues, and verified mileage- and driving-based insurance ratings. However, obtaining reliable driving data for these applications can be difficult. Users may be asked to estimate the distance they drive over a given period of time, but the users may be unable or unwilling to provide an accurate estimation, and may not truthfully quantify how safely they drive. Based on the incomplete information provided by users, it is often difficult to accurately quantify how a vehicle has been and will be driven.

SUMMARY

A driving data collection device is described herein. One embodiment of the driving data collection device comprises a vehicle interface adapted to interface an on-board diagnostics system of a vehicle and retrieve vehicle parameters of the vehicle from the on-board diagnostics system; a processor adapted to execute computer program instructions; and a non-transitory computer readable medium storing executable computer program instructions. The executable computer program instructions comprise a verification module executable to analyze the vehicle parameters to generate verification information indicating whether the device is in a correct vehicle; a tracking module executable to generate driving data describing how the vehicle is driven responsive to the vehicle parameters; and a reporting module executable to output the verification information and the driving data.

Also described herein is a non-transitory computer readable medium storing computer program instructions executable for collecting driving data from a vehicle. In one embodiment, the medium comprises a verification module executable to analyze vehicle parameters retrieved from an on-board diagnostics system of the vehicle to generate verification information indicating whether a driving data collection device interfaced with the vehicle is interfaced with a correct vehicle; a tracking module executable to generate driving data describing how the vehicle is driven responsive to the vehicle parameters; and a reporting module executable to output the verification information and the driving data.

A method of analyzing data about a vehicle used by a user is also described. In one embodiment, the method comprises receiving driving data and verification information collected by a driving data collection device interface with a vehicle; analyzing the verification information to determine a reliability score for the driving data, the reliability score representing a measure of whether the driving data accurately characterize the user's usage of the vehicle; and characterizing the user's usage of the vehicle responsive to the driving data and the reliability score.

DETAILED DESCRIPTION

The Figures (FIGS.) and the following description describe certain embodiments by way of illustration only. One skilled in the art will readily recognize from the following description that alternative embodiments of the structures and methods illustrated herein may be employed without departing from the principles of the invention described herein. Reference will now be made in detail to several embodiments, examples of which are illustrated in the accompanying figures.

Figure 1:
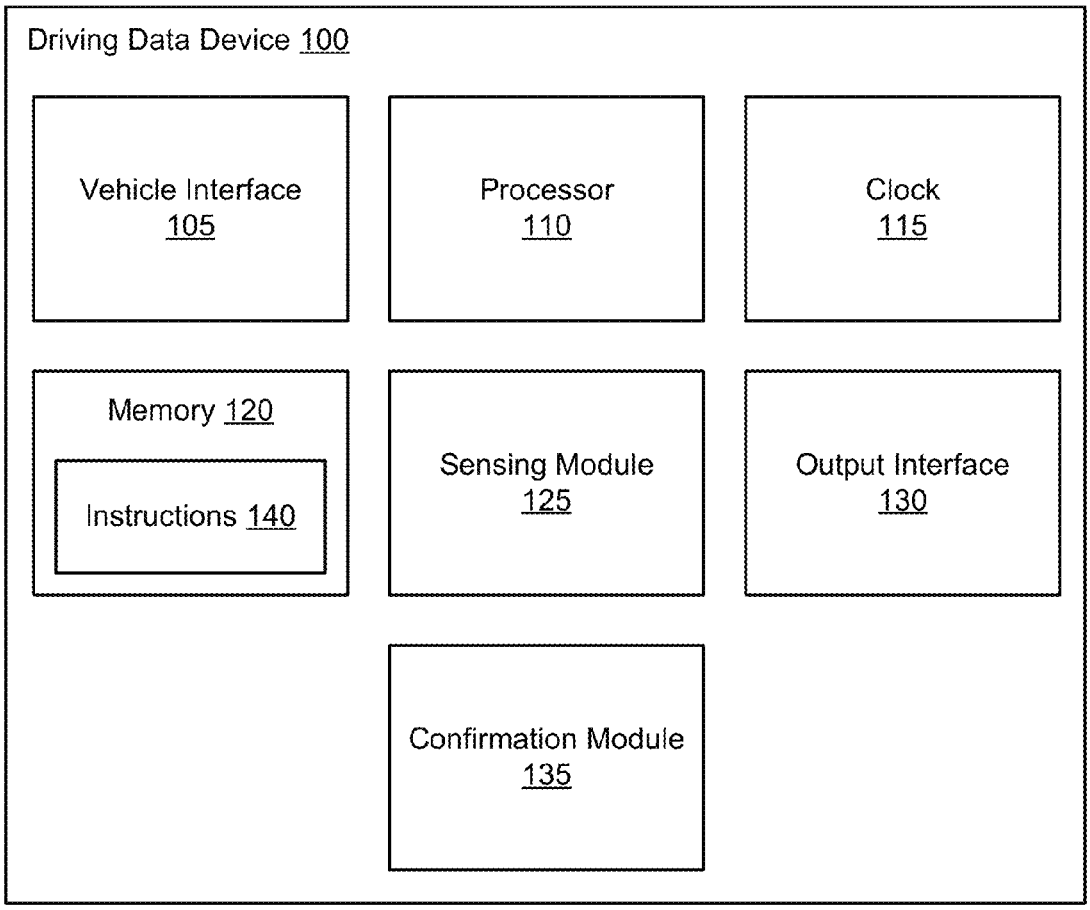
FIG. 1 is a block diagram illustrating components of a driving data collection device, according to one embodiment.

FIG. 1 is a block diagram illustrating components of a driving data collection device 100. One embodiment of the driving data collection device 100 comprises a vehicle interface 105, a processor 110, a clock 115, a memory 120, an output interface 130, a confirmation module 135, and a sensing module 125. Other embodiments of the driving data collection device include fewer or additional components. The driving data collection device may be, for example, a portable electronic device adapted to be inserted into a suitable adapter of a vehicle by a user (e.g., driver) of the vehicle.

The driving data collection device 100 collects data describing a vehicle and how the vehicle is driven by a user. The vehicle includes an on-board diagnostics (OBD) system that monitors parameters of the vehicle through communication with a number of nodes of the vehicle. Vehicle parameters monitored by the OBD system may include driving parameters, such as the vehicle's speed, odometer readings, fuel consumption, error codes, seatbelt use, passenger count, signal use, engine RPM, airbags status, anti-lock brake status, accident data, and near accident data; and identification parameters, such as the vehicle identification number (VIN) that uniquely identifies the vehicle, the signaling protocol or parameter identifiers used by the OBD system, and the voltage pattern of the vehicle during engine ignition or shutoff.

Each of the vehicle parameters may correspond to a unique parameter identifier (PID). A PID is a 16-bit hexadecimal value that is interpreted by the OBD system as identifying a particular parameter. Thus, the PID used to identify each parameter may vary depending on the signaling protocol of the OBD system or the make of the vehicle. The OBD system of the vehicle is configured to receive queries specifying a PID. In response to receiving the query, the OBD system determines the current value of the parameter corresponding to the PID and outputs the determined value.

The vehicle interface 105 of the driving data collection device 100 provides an interface between a vehicle and the device 100. In one embodiment, the vehicle interface 105 interfaces with the OBD data link connector of the vehicle to send queries to the vehicle's reporting systems and receive responses to the queries. The vehicle interface 105 comprises a connector having a pinout for interfacing with the vehicle's data link connector to read the vehicle parameters. The vehicle interface 105 may also include a voltmeter for measuring startup and shutoff voltage of the vehicle and a power interface for powering the device 100 from the vehicle. In one embodiment, the vehicle interface 105 receives power from the vehicle, which powers the internal operations of the driving data collection device 100. The driving data collection device 100 may also have a battery or other internal power source for powering the device when it is not interfaced with the vehicle.

The memory 120 stores instructions and data for the driving data device 100. The memory 120 may include one or more types of non-transitory computer memory, such as solid-state memory, a magnetic disk drive, or other memory type. The memory 120 may include persistent and/or non-persistent memory.

The processor 110 executes instructions 140 stored in the memory 120. The processor 110 retrieves data from the vehicle over the vehicle interface 105, processes the retrieved data, and stores the data in the memory 120 for output from the device 100. The processor 110 generates queries compatible with the vehicle's OBD system. In one embodiment, the processor 110 generates a query for identifying the vehicle in which the driving data collection device 100 is installed. The identification query may specify a PID corresponding to one or more of the identification parameters. In response to receiving the identification query, the vehicle returns the value of the corresponding identification parameter. The processor 110 stores the received value of the identification parameter in the memory 120. The processor 110 may generate an identification query when the device 100 is first installed in a vehicle, each time the vehicle is started, or at periodic intervals (e.g., once a week).

As the vehicle is driven, the processor 110 collects data describing the driving parameters. In one embodiment, the processor 110 collects data from the vehicle by generating queries for the vehicle's speed at a given sampling frequency. For example, the processor 110 may query the OBD system for the vehicle's speed once per second. At each query, the OBD system returns the current speed. The processor 110 stores the received values in the memory 120. Data describing other driving parameters may additionally or alternatively be collected and saved to the memory 120.

In another embodiment, the processor 110 collects data describing the driving parameters from the sensing module 125. The sensing module 125 may comprise one or more sensors, such as an accelerometer or a gyroscope. During operation of the vehicle, the processor 110 may receive data collected by the sensors, such as acceleration, and store the received data to the memory 120.

The processor 110 is further configured to output the driving data from the device 100 to the memory 120. In one embodiment, the processor 110 generates a compressed summary of the driving data collected over various periods of time. In this case, the processor 110 may output the compressed summary instead of raw data, or may output the compressed summary and a portion of the raw data. The compressed summary has a smaller data size than the raw data, and thus can be stored and transferred more efficiently.

The output interface 130 outputs data from the driving data collection device 100 to an external data storage device. For example, the output interface 130 may output the driving data, including the compressed summary, stored in the memory 120. In one embodiment, the output interface 130 includes a transmitter configured for wireless communication. For example, the output interface 130 may include a radio frequency transmitter configured to communicate by wireless local area networking, radio frequency identification (RFID), Near Field Communications (NFC), or BLUETOOTH. The output interface 130 may alternatively be configured to communicate by other wireless communication protocols. Alternatively, the output interface 130 may include an interface for wired communications by, for example, USB. The output interface 130 may also include a detachable memory device connected using a different technique.

In another embodiment, the output interface 130 is configured to write data to a magnetic stripe on an external card. In yet another embodiment, the output interface 130 is a screen (e.g., a liquid crystal display) configured to display a number or a linear or matrix barcode encoding the output data. The output interface 130 may alternatively include a printer for printing out a ticket with the number, linear barcode, or matrix barcode. The ticket may be adhesive on one side, enabling the ticket to adhere to an external card or other object.

In one embodiment, the output interface 130 also includes an alignment guide to help a user align the external data storage device with the transmitter of the output interface 130. The alignment guide may comprise a magnet placed in the center of the transmitter and/or at another alignment location. The external device may have a magnetic component located such that the magnetic component aligns with the magnet in the output interface when the receiver of the external device is aligned with the transmitter, thereby ensuring proper alignment of the external data storage device. Alternatively, the alignment guide may be a marking such as a hole, a dot, a notch, or a knob that aligns with an analogous structure on the external device.

The confirmation module 135 notifies a user when data transfer is in progress and confirms when the data transfer is complete. In one embodiment, the confirmation module 135 includes an LED or other form of light emitter. For example, the LED may light up briefly when the user plugs the device 100 into a vehicle. As another example, the LED may blink during data output over the output interface 130 to indicate to the user that the data transfer process is occurring. The confirmation module 135 may additionally or alternatively include a speaker for outputting a sound, such as a beep, to indicate to a user when data transfer is complete, or an actuator for providing haptic feedback to users.

Figure 2:
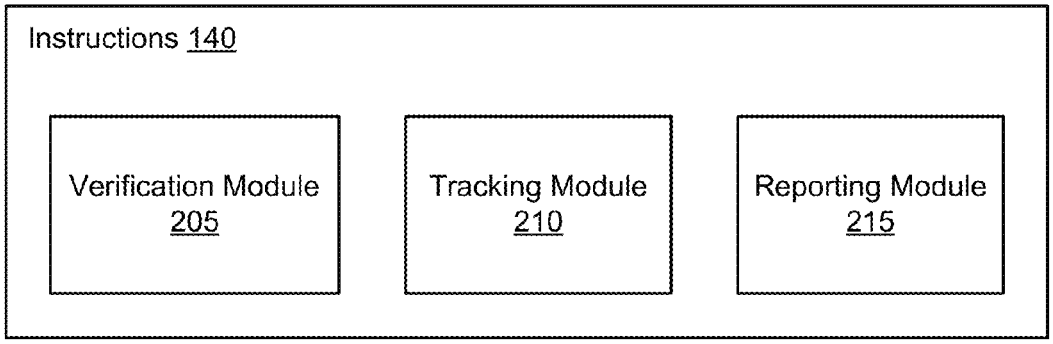
FIG. 2 illustrates executable modules stored in the memory of the driving data collection device, according to one embodiment.

FIG. 2 illustrates modules within the instructions 140 that are executed by the processor 110 to perform the functions described above. In the illustrated embodiment, the instructions 140 include a verification module 205, a tracking module 210, and a reporting module 215. Other embodiments may include different and/or additional modules.

The verification module 205 generates vehicle verification information indicating whether the data driving device 100 is installed in the correct (i.e., intended or expected) vehicle. In one embodiment, the verification module 205 analyzes vehicle parameters to determine whether the vehicle in which the device 100 is installed is the vehicle for which the driving data device 100 is intended. To this end, the verification module 205 identifies the vehicle in which the data driving device 100 is installed. In one embodiment, the verification module 205 queries the vehicle's OBD system and compares the identification of the vehicle to an expected identification of the vehicle to verify that the identified vehicle is the expected vehicle. The verification module 205 compares the VIN received at the vehicle interface 105 to the expected VIN stored in the memory 120.

If the received VIN matches the expected VIN, the verification module 205 generates verification information indicating that the device 100 is installed in the correct vehicle. If the VINs do not match, the verification module 205 generates verification information indicating that the device 100 is not installed in the correct vehicle.

If the vehicle's VIN is not received at the vehicle interface 105, the verification module 205 is otherwise unable to access the vehicle's VIN, or further verification is desired, the verification module 205 uses one or more other techniques to generate verification information indicating whether the device 100 is installed in the correct vehicle. In one embodiment, the verification module 205 generates verification information based on whether the signaling protocol employed by the vehicle's OBD interface matches an expected signaling protocol for the vehicle. For example, based on the make or year of the expected vehicle, the vehicle may be expected to use a particular one of the five protocols of the OBD-II standard. The verification module 205 compares the identified protocol to the expected protocol of the vehicle in which the device 100 is installed. Alternatively, the verification module 205 may generate verification information based on the set of PIDs supported by the vehicle's OBD system. In this case, the verification module 205 queries the OBD system of the vehicle in which the device 100 is installed to identify the PIDs supported by the OBD system. The verification module 205 compares one or more of the identified PIDs to PIDs expected to be supported by the vehicle.

In one embodiment, the verification module 205 uses analog electronic characteristics of the vehicle to generate the verification information. For example, the verification module 205 measures the voltage applied during ignition or shutoff of the vehicle's engine. Different vehicles may have different voltage patterns during startup or shutoff. The verification module 205 receives the voltage measured by the voltmeter of the vehicle interface 105, and compares the measured voltage pattern to an expected voltage pattern for the vehicle. The verification module 205 generates verification information indicating whether the measured voltage pattern matches the expected voltage pattern.

Furthermore, the verification module 205 detects and logs connections and disconnections of the device 100 from the vehicle and includes these events in the verification information. When the device 100 is connected to (or disconnected from) the vehicle, the verification module 205 reads the time of the connection (or disconnection) from the clock 115 and logs the time in the memory 120. In one embodiment, the verification module 205 maintains a count of the number of times the device 100 was disconnected from the vehicle for a duration exceeding a preset threshold, such as five minutes. The verification module 205 may also record the total duration of each disconnection that exceeds the threshold and the time between the disconnections.

The tracking module 210 receives driving parameters from the vehicle interface 105. Using the driving parameters, the tracking module 210 generates driving data describing how the vehicle is driven. The driving data derived by the tracking module 210 includes, for example, times the vehicle is driven, distance driven, speed and acceleration of the vehicle, or an amount of fuel used by the vehicle.

When the vehicle is driven, the tracking module 210 determines a length of time the vehicle is in motion (referred to herein as a "motion interval"). In one embodiment, the tracking module 210 identifies the motion interval based on the speed of the vehicle. Each time the speed transitions from zero to a non-zero value, the tracking module 210 reads the current time from the clock 115 and stores the time in the memory 120 as a motion start time. Similarly, each time the speed transitions to zero, the tracking module 210 reads the time from the clock 115 and records the time in the memory 120 as a motion stop time. The time between the recorded motion start time and stop time is the motion interval. Depending upon the environment, the tracking module 210 may discount certain speed transitions, such as transitions that are likely to occur at stop signs or traffic lights, so that the motion intervals surrounding these transitions are aggregated into a single motion interval.

The tracking module 210 may also identify the motion start and stop times based on the voltage measured by the voltmeter of the vehicle interface 105 or based on the engine RPM. For example, each time the engine RPM increases above a preset threshold (e.g., 1000 RPM), the tracking module 210 records the corresponding time in the memory 120 as the motion start time. By recording the start and stop time of each motion interval, the tracking module 210 generates a log indicating times of day the vehicle is driven, how often the vehicle is driven, and for how long the vehicle is driven.

In one embodiment, the tracking module 210 calculates distance traveled by the vehicle using the motion intervals. The tracking module 210 may multiply the average speed over the motion interval by the interval's duration to determine the distance traveled by the vehicle during the interval. Alternatively, the tracking module 210 may divide the speed received at each query by the sampling frequency and sum the result over the motion interval to calculate the distance traveled. In another embodiment, the tracking module 210 estimates the distance traveled by the vehicle based on the duration of each motion interval. For example, the tracking module 210 may multiply the duration of the motion interval by an expected average speed, such as 30 miles per hour.

In one embodiment, the tracking module 210 determines acceleration of the vehicle using an accelerometer or by calculating rates of change of the vehicle's speed. The tracking module 210 records the calculated acceleration in the memory 120 and/or a count of times the acceleration exceeds a threshold. For example, if the tracking module 210 detects an acceleration above a threshold indicating that the user likely braked quickly to avoid an accident, the tracking module 210 records a time stamp of the incident and increments a count of hard braking events.

The reporting module 215 reports data generated by the driving data device 100 to the external data storage device via the output interface 130. The reported data may include, for example, driving data derived by the tracking module 210 and verification information generated by the verification module 205.

In one embodiment, the reporting module 215 generates a summary of the data collected by the device 100 to reduce the amount of data transferred to the external device. For example, the reporting module 215 may calculate a sum of the total distance the vehicle was driven over a given time period, such as one month or one year, and/or a breakdown of the distance traveled during various intervals of a day. The reporting module 215 may also determine, based on the distances calculated by the tracking module 210 and the recorded time of each motion interval, that the vehicle was driven 1000 miles over the course of a year. Out of the 1000 miles, 400 miles were driven between 6 AM and 8 AM, 400 miles were driven between 4 PM and 6 PM, and 200 miles were driven between 1 AM and 3 AM.

In one embodiment, the reporting module 215 generates a summary of the data collected by the device 100. The data summary is a data file representing identification data and driving data in a compact format. In one embodiment, the data summary includes a set of data fields each assigned to particular items of driving data. The reporting module 215 generates the data summary by determining a value for the data item corresponding to each data field based on the verification information generated by the verification module 205 or the driving data generated by the tracking module 210.

An example data summary generated by the reporting module is shown in Table 1, in which various data items are assigned to particular fields of the file:

TABLE 1

| Field Nos. | Data |
|---|---|
| 1-5 | Encryption information |
| 6-18 | Identification, dates, error codes, etc. |
| 19-54 | Driving data synopsis |
| 55-175 | 12-month detailed driving data summary |
| 176-187 | Hard braking events |
| 188-202 | Recent trips |

Additional, fewer, or different data fields than those illustrated in Table 1 may be included in the file.

The encryption information data fields identify an encryption scheme used to encrypt the data summary. In one embodiment, the reporting module 215 calculates the encryption information based on other data fields of the data summary. Thus, third-party attempts to manipulate the data can be detected using the encryption information. Other encryption information may additionally or alternatively be added to these data fields, such as an encryption key.

The data summary includes a set of data fields corresponding to basic information about the vehicle and the device 100 installed in the vehicle, such as the vehicle's VIN and/or OBD signaling protocol, an identifier of the device 100, the date the device 100 was installed in the vehicle, and vehicle error codes (e.g., the last three unique error codes measured by the device 100).

The driving data synopsis data fields summarize driving data collected over various periods of time. For example, the driving data synopsis may include a summary of driving data from the past 30 days, the past calendar year, the past 12 months, and the total length of time since the device 100 was installed in the vehicle. Example driving data for each of these time periods that are included in the summary are the number of trips, total minutes the vehicle was in motion, minutes the vehicle was in motion during particular times of day (e.g., late night or rush hour minutes), mileage driven, number of hard braking events, and volume of fuel consumed.

In one embodiment, the reporting module 215 generates the driving data synopsis using exponential binning. Exponential binning assigns values of the driving data to "bins" of increasing exponential size. The number of the bin to which a value was assigned is used to encode the value. Since the driving data values are represented by a bin number instead of a unique, linearly-increasing hexadecimal value, exponential binning reduces the number of bytes needed to represent the values of the driving data. For example, to encode the driving data values in one byte, the reporting module 215 assigns the values to bins numbered from 0 to 255. For example, the reporting module 215 encodes a value x as a bin number y in the range (0, 255) by the following equation:

$$y = \min\left[255, \operatorname{floor}\left(\frac{\ln(x+1)}{\ln(1+\delta)}\right)\right] \tag{1}$$

in which δ is a constant used to determine a size of each bin. For example, if δ=0.05, Equation (1) encodes values between 0 and approximately 250,000 as integer bin numbers from 0 to 255. Larger values of δ enable larger driving data values to be encoded with the same number of bins, while smaller values of δ reduce encoding error.

The twelve-month detailed driving data fields include a more detailed summary of recent driving data, such as driving data collected over the past 12 months. The detailed summary may include disconnections of the device 100 from the vehicle, such as the total number of disconnects, the number of disconnects exceeding threshold lengths of time (e.g., number of disconnects longer than five minutes), and/or the number of days on which a disconnect occurred. The detailed summary may additionally or alternatively include the number of days on which the device 100 was disconnected from the vehicle for greater than a threshold length of time, such as five minutes. The detailed summary may also include hard braking events, hourly divisions of driving data, or other information.

The hard braking events data fields list dates, times, and recorded accelerations of hard braking events. In one embodiment, the data summary includes the dates, times, and accelerations of the three hardest braking events in the last 12 months and the dates, times, and accelerations of the last three hard brakes (that is, braking events with acceleration exceeding a threshold, such as 8 miles per hour per second). In one embodiment, the hard braking events further include "accelobrakes," or a significant acceleration followed shortly thereafter by a significant deceleration. An accelobrake is defined as a short period of time in which the tracking module 210 records both a large positive acceleration (e.g., the vehicle gaining speed at a rate faster than a threshold) and a large negative acceleration (e.g., the vehicle's speed falling at a rate faster than a threshold).

The recent trips data fields include driving data collected during recent trips, such as the dates and times of the trips, minutes and distance driven, hard braking events, and fuel consumed.

The reporting module 215 may also add raw data (e.g., vehicle parameters, verification information, and/or driving data) stored in the memory 120 to the data file. For example, the reporting module 215 may generate a compressed data summary as described above, then add raw data to the data file until the data file reaches a predetermined size.

The reporting module 215 configures the data file for transmission to an external device by the output interface 130. Thus, depending on the configuration of the output interface 130, the reporting module 215 formats the data file as an NFC data exchange format (NDEF) message, encodes the data file in a barcode or numeric format, and so forth.

Figure 3:
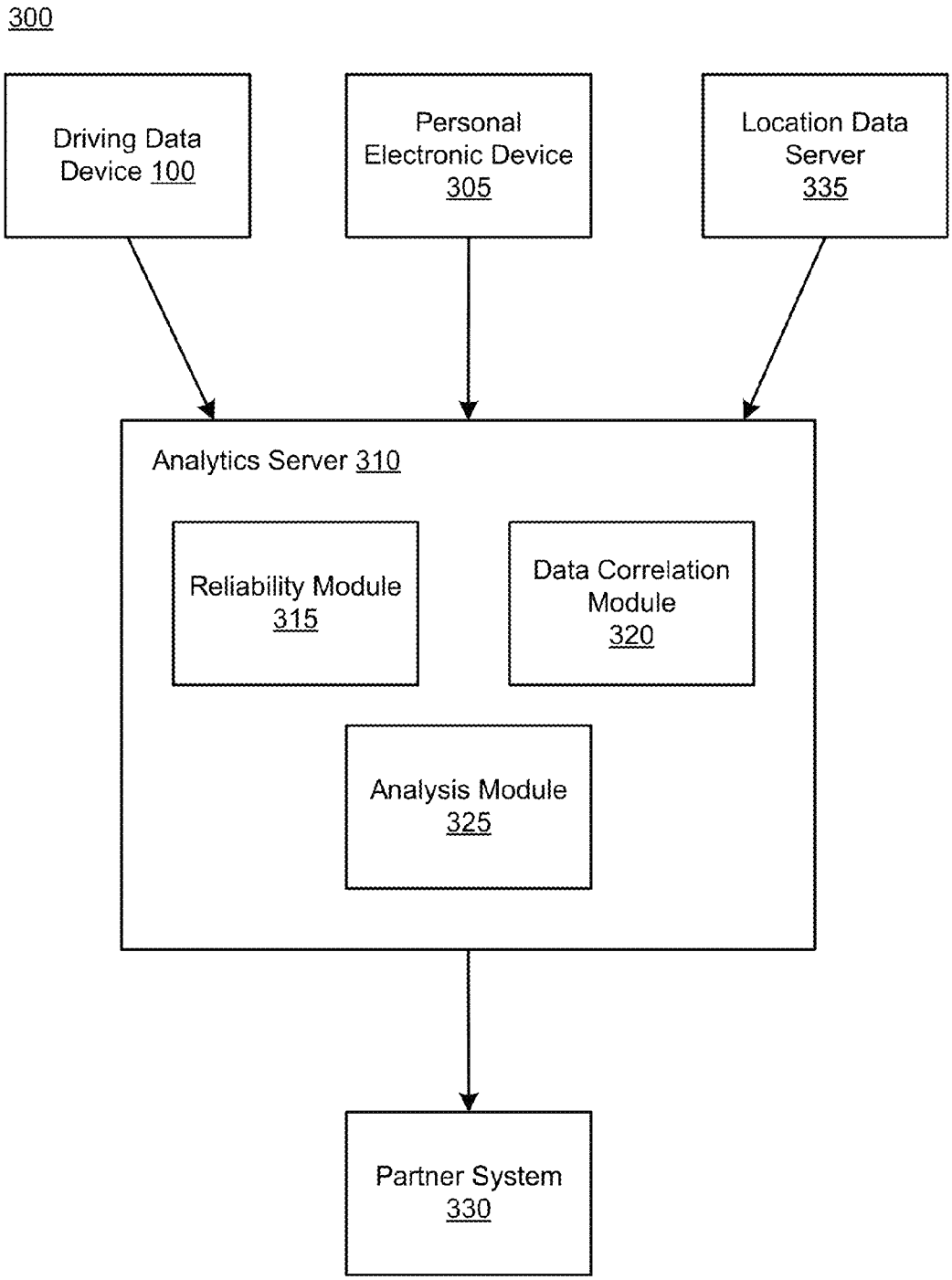
FIG. 3 illustrates an example environment for use of the data collected by the driving data collection device, according to one embodiment.

FIG. 3 illustrates an example environment 300 for use of the data collected by the driving data collection device 100. One embodiment of the environment 300 includes an analytics server 310, a location data server 335, a driving data collection device 100 and personal electronic device 305 of a user, and a partner system 330. Other embodiments of the environment 300 may include additional or fewer systems, and the functionality may be distributed differently between the systems. For example, in one embodiment, the analytics server 310 is a subsystem of the partner system 330.

The user registers with the analytics server 310. An operator of the analytics server 310 sends the registered user a driving data collection device 100 to install in the user's vehicle. Prior to sending the device 100 to a user, the operator of the analytics server 310 may set the time on the clock 115. The operator may also set expected values for the identification parameters of the user's vehicle in the memory 120 of the device 100 based on information provided by the user during registration. When the user receives the device 100, the user installs the driving data collection device 100 in the user's vehicle by, for example, plugging the device 100 into the OBD data link connector of the vehicle. As the vehicle is used, the device 100 collects data about the vehicle as well as when and how the vehicle is driven.

The user may periodically (e.g., every twelve months) transfer data from the driving data collection device 100 to an external data storage device. An example device to which the user may transfer data is a mailable data storage device with an embedded memory and an antenna configured to receive data from a transmitter of the device 100. A mailable data storage device is described in U.S. Provisional Application No. 61/791,191, filed Feb. 5, 2013, which is incorporated herein by reference in its entirety. Alternatively, data may be transferred to a user's personal electronic device 305 by wired or wireless communication, such as BLUETOOTH, NFC, or USB. In some cases, depending on the structure of the output interface 130 and the external data storage device, the user holds the external device near the driving data collection device 100 to transfer data to the external device. The alignment guide of the output interface 130 may assist the user in properly aligning the external device. After the external device has been aligned with the transmitter of the driving data collection device 100, an LED of the confirmation module 135 may flash to indicate to the user that the data transfer is in progress. The device 100 transfers the data file generated by the reporting module 215 to the external device, and beeps emitted by the speaker of the confirmation module 135 or flashes of the LEDs may indicate to the user when the data transfer is complete. Alternatively, the user may swipe the external device through a magnetic stripe writer on the device 100, print an adhesive barcode from the device 100 and affix the barcode to the external device, scan a barcode displayed by the device 100, or write a number displayed by the device 100 on the external device. In one embodiment, the user's personal electronic device 305, such as a mobile phone, media player, tablet, or wearable electronic device, serves as the external data storage device.

In one embodiment, after transferring data to the external device, the user mails the external device to an operator of the analytics server 310. Alternatively, if the external device is the user's personal electronic device 305, the personal device 305 may periodically upload the collected data to the analytics server 310 over a network, such as a cellular network or the Internet.

In one embodiment, the external device stores updates to the software of the device 100. Prior to transferring data to the external device, the device 100 may receive the software updates from the external device.

The user may also bring one or more personal electronic devices 305 into the vehicle whenever the user operates the vehicle. If multiple users are in the vehicle simultaneously, each user may bring one or more personal devices 305 into the vehicle. In one embodiment, the user's personal device 305 also collects personal data describing the user's driving patterns. For example, the user may execute a data collection application on the personal device 305 that for the purpose of collecting personal driving data. The parameters measured by the personal device 305 may include time, speed, acceleration, global positioning, address, city, county, ZIP code, state, other geographic area, road, road type, traffic, weather conditions, phone use (talking, hands-free, emailing, texting, gaming, etc.), or the identity of the driver operating the vehicle. Data may be continuously recorded and later correlated against the measured start and stop times of the vehicle.

The personal devices 305 may collect data only when the vehicle is in operation. For example, the driving data collection device 100 may launch the data collection application on a personal device 305 via wireless communication (e.g., BLUETOOTH) when the user starts the vehicle or when the user tags the personal device 305 against the device 100 (e.g., when entering or leaving the vehicle). Alternatively, the personal device 305 may launch the application when the speed increases above a threshold amount (e.g., 10 miles per hour). The personal device 305 provides the collected data to the analytics server 310.

The location data server 335 includes one or more computers and stores information describing characteristics of the environment where the user's vehicle is located while it is being driven. For example, the location data stored by the location data server 335 may include weather, road type, and traffic data in the region in which the vehicle is currently located. The analytics server 310 may communicate with the location data server 335 over a network (e.g., the Internet), or the personal device 305 may retrieve location data from the location data server 335 and transmit the retrieved data to the analytics server 310.

The analytics server 310 processes the data collected by the driving data collection device 100, the location data server 335, and/or the personal device 305. As illustrated in FIG. 3, one embodiment of the analytics server 310 comprises a reliability module 315, a data correlation module 320, and an analysis module 325.

The reliability module 315 analyzes the vehicle verification information generated by the verification module 205 to determine a reliability score for the driving data associated with a user and/or vehicle. The reliability score represents a measure of trustworthiness of the driving data, i.e., whether the driving data accurately characterizes the user's usage of the vehicle. The reliability score may be, for example, a number between 0.0 and 1.0, with a greater value indicating greater trustworthiness. The reliability module 315 determines the reliability score based on factors such as the identification of the vehicle in which the driving data collection device 100 is installed, the number of disconnects of the device 100, the number of days the device was disconnected for greater than a threshold length of time (e.g., five minutes), or other factors. In one embodiment, the reliability module 315 assigns different weights to different factors, and generates the reliability score based on a combination of the weighted factors.

A reliability score of 0.0 indicates that the associated driving data is entirely unreliable. For example, if the device 100 was installed in an incorrect vehicle, the data received from the device 100 cannot be used to characterize the correct vehicle. Thus, if the VIN identified for the vehicle in which the device 100 was installed does not match the expected VIN, the reliability module 315 may assign a reliability score of 0.0 to data received from the device 100. In contrast, a reliability score of 1.0 indicates that the associated driving data is reliable. For example, the device 100 had been continuously installed in the correct vehicle, and thus the received data accurately characterizes how the vehicle was driven. As another example, if the identified VIN matches the expected VIN, but the device 100 was disconnected from the vehicle for fifteen days in the last year, the reliability module 315 may assign a reliability score of 0.8 to the driving data received from the device 100, indicating that the driving data is at least partly trustworthy.

The data correlation module 320 correlates data received from the driving data collection device 100 with data received from the personal electronic device 305 and/or the location data server 335. In one embodiment, the data correlation module 320 identifies the periods corresponding to vehicle motion based on the start and stop times measured by the driving data collection device 100. The data correlation module 320 retrieves data collected during the identified motion intervals by the personal device 305, corresponding to the personal device-measured parameters.

The retrieved data may be used to verify the data received from the driving data collection device 100, such as speed or distance data. Thus, the data correlation module 320 or the reliability module 315 may modify the reliability score based on how well the driving data from the driving data collection device 100 correlates with data received from the personal electronic device 305 and/or the location data server 335.

The data correlation module 320 may also use the received data as additional information pertaining to the user or the driving habits of the user. For example, the data correlation module 320 may identify the driver of the vehicle during each motion interval by identifying the owner of the personal device 305 that is in the vehicle. As another example, the data correlation module 320 may retrieve data from the personal device 305 indicating the number of text messages sent by the user during each motion interval. Similarly, the data correlation module 320 may retrieve location data corresponding to each motion interval from the location data server 335. For example, using the global positioning of the personal device 305, the data correlation module 320 may retrieve weather conditions at the location of the user's vehicle during a motion interval, the type of road on which a user drove, and the amount of traffic on the road.

The analysis module 325 analyzes the driving parameters in conjunction with the reliability score and the correlated data to produce characterizations of the user's driving behavior and usage of the vehicle. These characterizations may make use of data from the driving data device 100, personal electronic device 305, and location data server 335. For example, the characterizations may describe when the vehicle is driven by different users, how the vehicle is driven on different types of roads or in different weather conditions, etc. These characterizations may be used for a variety of purposes.

In one embodiment, the characterizations produced by the analysis module 325 are provided to a partner system 330. In addition, the raw driving data may be provided to the partner system 330. In one embodiment, the partner system 330 uses the analyzed driving data and/or the raw driving data to derive user-specific driving costs. As one example, the partner system 330 is operated by a provider of the user's car insurance. The operator of the analytics server 310 partners with the operator of the partner system 330 to calculate discounts for the user's insurance based on the driving patterns of the user. The analytics server 310 and/or the partner system 330 calculate an insurance discount for the user based on the user's driving data, and the partner system 330 adjusts the cost of the user's insurance based on the calculated discount. In another example, the partner system 330 uses driving data to calculate mileage- and driving-based fees for the user based on the user's driving habits.

In one embodiment, the discount for the user's insurance is based on the total distance the user drove the vehicle and/or the distance driven at different times of day. For example, a user who drove the vehicle fewer miles over the course of six months may receive a greater discount than a user who drove the vehicle farther over the same time, for equivalent reliability scores. As another example, data corresponding to a greater reliability score (e.g., 0.9) may lead to a greater discount than data corresponding to a low reliability score (e.g., 0.2). The discount may also be based on a combination of the type of roads on which the user drove, weather conditions during the motion intervals, and time of day of the motion intervals. As another example, a user who has a greater number of hard braking events may receive a smaller discount than a user with fewer such events. In yet another example, a user who frequently sends text messages via the personal device 305 during motion intervals may receive a smaller discount than a user who does not send text messages. Numerous other methods for calculating an insurance discount are possible.

In one embodiment, the partner system 330 provides a website for the user to manage and track driving data, such as times the vehicle is driven, fuel consumption, error codes, and the like. In this case, the partner system 330 may be used by the user and others to manage driving data for numerous applications for which accurate and reliable driving data could be beneficially employed, such as vehicle maintenance and repair, vehicle resale, driver information, accident reconstruction, or legal issues.

Figure 4:
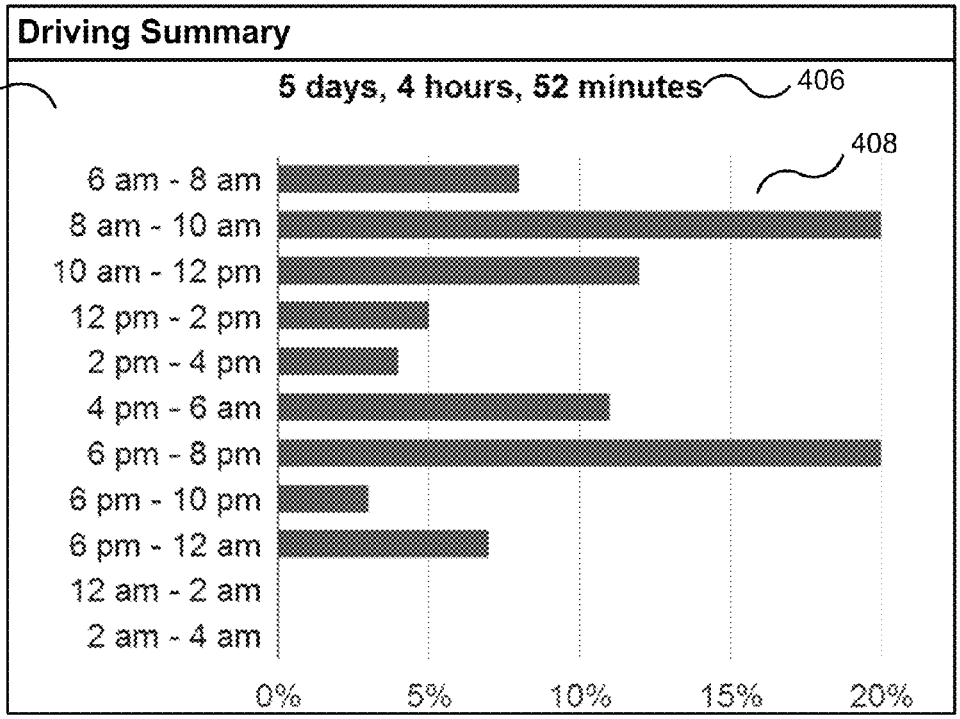
FIG. 4 illustrates an example website user interface displaying driving data, according to one embodiment.

FIG. 4 illustrates an example website 400 user interface displaying driving data to the user, presented to the user by the partner system 330. In the example illustrated in FIG. 4, the website 400 includes a driving summary 405 and various properties 410 of the driving data collection device 100 used by the user, the user's vehicle, and the user's driving data. The driving summary 405 provides a total amount of time 406 the vehicle has been driven (e.g., in the past year), as well as a breakdown 408 of the total time into various periods of the day. The website 400 also includes various properties 410 of the user's vehicle, the driving data collection device 100 used by the user, and the user's driving data. Other data, such as other identification parameters or driving parameters, may additionally or alternatively be presented by the website 400.

Additional Configuration Considerations

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Some portions of this description describe the embodiments of the invention in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer readable medium containing computer program code, which can be executed by a computer processor for performing any or all of the steps, operations, or processes described.

Embodiments of the invention may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the invention may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention.

What is claimed is:

1. A driving data collection device, comprising:

a vehicle interface adapted to interface with an on-board diagnostics system of a vehicle and retrieve vehicle parameters of the vehicle from the on-board diagnostics system while the driving data collection device is physically connected to the vehicle;

an output interface adapted to output data by near field communication;

a processor adapted to execute computer program instructions; and a non-transitory computer readable medium storing executable computer program instructions that when executed by the processor cause the processor to:

analyze the vehicle parameters to generate verification information indicating whether the driving data collection device is in a correct vehicle;

generate driving data describing how the vehicle is driven responsive to the vehicle parameters;

detect when the driving data collection device is physically connected to and disconnected from the vehicle;

generate a log identifying the connections and disconnections;

generate a data file containing a summary of the driving data, the log, and the verification information and smaller than a predetermined file size, wherein generating the data file comprises:

generating a compressed summary of the driving data;

adding the compressed summary of the driving data to the data file; and adding raw driving data to the data file to which the compressed summary was added until the data file reaches the predetermined file size; and output the data file to an external user device by the output interface.

2. The driving data collection device of claim 1, wherein the computer program instructions, when executed by the processor, further cause the processor to:

compare an identification of the vehicle indicated by the vehicle parameters with an expected identification of the vehicle to determine whether the driving data collection device is in the correct vehicle.

3. The driving data collection device of claim 2, wherein the comparison comprises comparing a signaling protocol used by the vehicle with an expected signaling protocol for the vehicle.

4. The driving data collection device of claim 2, wherein the comparison comprises comparing analog electronic characteristics of the vehicle with expected analog electronic characteristics for the vehicle.

5. The driving data collection device of claim 1, wherein the output interface comprises a magnet adapted to align the external user device with the output interface, the data file being transferred to the external user device when the external user device is aligned with the output interface.

6. The driving data collection device of claim 1, further comprising:

a clock;

wherein detecting when the driving data collection device is physically connected to and disconnected from the vehicle comprises reading a time from the clock when the driving data collection device is connected to or disconnected from the vehicle.

7. The driving data collection device of claim 1, wherein the driving data identifies one or more accelerations of the vehicle exceeding a threshold, and wherein generating the data file containing the summary of the driving data comprises:

generating a synopsis representing the driving data collected over one or more time periods, the synopsis including the identified one or more accelerations; and adding at least one synopsis to the data file.

8. A non-transitory computer readable storage medium storing computer program instructions executable for collecting driving data from a vehicle, the computer program instructions when executed by a processor causing the processor to:

analyze vehicle parameters retrieved from an on-board diagnostics system of the vehicle to generate verification information indicating whether a driving data collection device interfaced with the vehicle is interfaced with a correct vehicle;

generate driving data describing how the vehicle is driven responsive to the vehicle parameters;

detect when the driving data collection device is physically connected to and disconnected from the vehicle;

generate a log identifying the connections and disconnections;

generate a data file containing a summary of the driving data, the log, and the verification information and smaller than a predetermined file size, wherein generating the data file comprises:

generating a compressed summary of the driving data;

adding the compressed summary of the driving data to the data file; and adding raw driving data to the data file to which the compressed summary was added until the data file reaches the predetermined file size; and output the data file to an external user device by an output interface adapted to output data by near field communication.

9. The non-transitory computer readable storage medium of claim 8, wherein the computer program instructions, when executed by the processor, further cause the processor to:

compare an identification of the vehicle indicated by the vehicle parameters with an expected identification of the vehicle to determine whether the driving data collection device is in the correct vehicle.

10. The non-transitory computer readable storage medium of claim 9, wherein the comparison comprises comparing a signaling protocol used by the vehicle with an expected signaling protocol for the vehicle.

* * * * *